US008078093B2

(12) United States Patent
Sasaoka et al.

(10) Patent No.: US 8,078,093 B2
(45) Date of Patent: Dec. 13, 2011

(54) RECORDING MATERIAL PROCESSING APPARATUS HAVING IMAGE FORMING APPARATUS AND POST PROCESSING DEVICE

(75) Inventors: Yoshimasa Sasaoka, Kanagawa (JP); Ryuichi Shiraishi, Kanagawa (JP); Toshio Kawachidani, Kanagawa (JP); Tsuyoshi Nakamura, Kanagawa (JP); Munetake Nagata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 232 days.

(21) Appl. No.: 12/330,047

(22) Filed: Dec. 8, 2008

(65) Prior Publication Data

US 2009/0226204 A1 Sep. 10, 2009

(30) Foreign Application Priority Data

Mar. 6, 2008 (JP) ..... P2008-056607

(51) Int. Cl.
*G03G 15/00* (2006.01)

(52) U.S. Cl. ..... 399/405; 399/407; 399/408; 399/409; 399/410

(58) Field of Classification Search ..... 399/405, 399/407–410
See application file for complete search history.

(56) References Cited

U.S. PATENT DOCUMENTS

| | | | | |
|---|---|---|---|---|
| 2001/0007621 | A1* | 7/2001 | Mogi | 400/630 |
| 2002/0097428 | A1* | 7/2002 | Ferlitsch | 358/1.15 |
| 2002/0131786 | A1* | 9/2002 | Sato et al. | 399/407 |
| 2003/0180074 | A1* | 9/2003 | Noya et al. | 399/328 |

FOREIGN PATENT DOCUMENTS

| | | |
|---|---|---|
| JP | 2003-228205 | 8/2003 |
| JP | 2003-323087 | 11/2003 |
| JP | 2004-059242 | 2/2004 |
| JP | 2006-056670 | 3/2006 |

* cited by examiner

*Primary Examiner* — Ryan Walsh
(74) *Attorney, Agent, or Firm* — Morgan, Lewis & Bockius LLP

(57) ABSTRACT

A recording material processing apparatus includes an image forming apparatus, a post-processing device, a recording material judging section and a recording material transport controlling section. The recording material judging section judges whether the recording material used in the image forming apparatus has post-processing permissible size and thickness or not. And the recording material transport controlling section that, permits when the recording material judging section judges the recording material has the post-processing permissible size and thickness, the recording material to be transported into the post-processing device and prohibits when the recording material judging section judges the recording material does not have the post-processing permissible size and thickness, the recording material to be transported into the post-processing device.

7 Claims, 11 Drawing Sheets

RECORDING MATERIAL PROCESSING APPARATUS HAVING IMAGE FORMING APPARATUS AND POST PROCESSING DEVICE

CROSS-REFERENCE TO RELATED APPLICATIONS

This application is based on and claims priority under 35 USC 119 from Japanese Patent Application No. 2008-056607 filed Mar. 6, 2008.

BACKGROUND

The present invention relates to a recording material processing apparatus.

A recording material processing apparatus in which a recording material output from an image forming apparatus thereof is subjected to post-processing has been proposed, where both a recording material subjected to the post-processing and a recording material not subjected to the post-processing are transported through the similar transport path.

SUMMARY

According to an aspect of the invention, a recording material processing apparatus includes an image forming apparatus, a post-processing device, a recording material judging section, and a recording material transport controlling section. The image forming apparatus includes an imaging section that forms an image on a recording material; and a first recording material output portion onto which the recording material having the image formed thereon by the imaging section is output and accommodated. The post-processing device is provided attached to the image forming apparatus. The post-processing device includes a post-processing section that selectively subjects a recording material having post-processing permissible size and thickness to a post-processing; and a second recording material output portion onto which the recording material passed through the post-processing section is output and accommodated. The recording material judging section judges whether the recording material used in the image forming apparatus has the post-processing permissible size and thickness or not. The recording material transport controlling section permits, when the recording material judging section judges the recording material has the post-processing permissible size and thickness, the recording material to be transported into the post-processing device, and permits, when the recording material judging section judges the recording material does not have the post-processing permissible size and thickness, the recording material to be transported to the first recording material output portion.

BRIEF DESCRIPTION OF THE DRAWINGS

Exemplary embodiment(s) of the present invention will be described in detail based on the following figures, wherein:

FIGS. 6A to 6C are an explanatory view showing advantages of the layout of the punching section, in which FIG. 6A shows an example according to the exemplary embodiment model, FIG. 6B shows an example of a first comparison model, and FIG. 6C shows an example of a second comparison model;

DETAILED DESCRIPTION

Firstly, the outline of an exemplary embodiment model to which the invention is applied will be described.

[Outline of Exemplary Embodiment Model]

Figure 1:
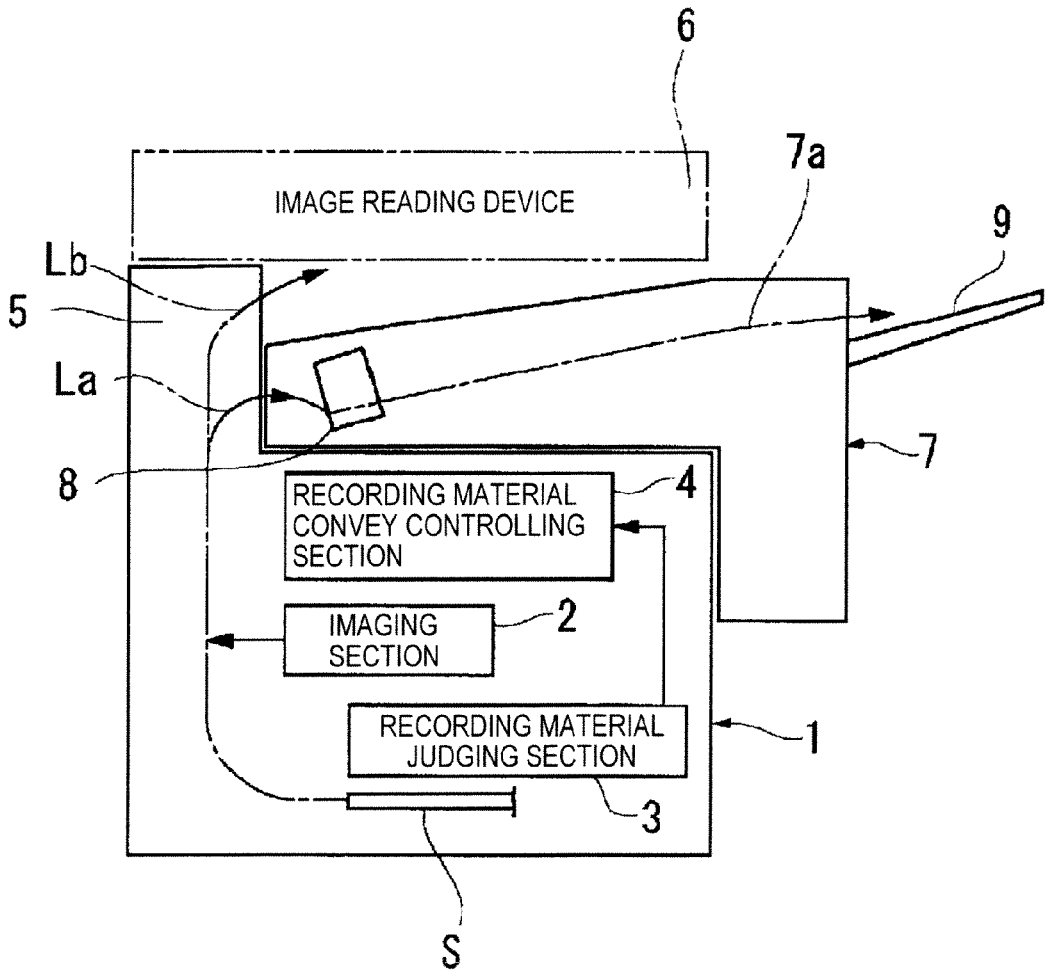
FIG. 1 is an explanatory view showing the outline of a recording material processing apparatus according to an exemplary embodiment model of the invention.

FIG. 1 shows the outline of a recording material processing apparatus according to an exemplary embodiment model which embodies the invention. One of typical models of such the recording material processing apparatus, as shown in FIG. 1, includes an image forming apparatus 1 having an imaging section 2 which forms an image on a recording material S and a recording material output portion onto which the recording material S having the image formed by this imaging section 2 is output and accommodated; a post-processing device 7 which is provided attached to this image forming apparatus 1, and has a post-processing section 8 which subjects a recording material S having the post-processing permissible size and thickness to the predetermined post-processing selectively and a recording material output portion 9 onto which the recording material S after passing through the post-processing section 8 is output and accommodated; a recording material judging section 3 which judges whether the recording material S used in the image forming apparatus 1 is a recording material S having the post-processing permissible size and thickness or not; and a recording material transport controlling section 4 which, on the basis of a result of judgment by this recording material judging section 3, permits the recording material S judged to have the post-processing permissible size and thickness to be received into the post-processing device 7 and prohibits the recording material S judged not to have the post-processing permissible size and thickness from being received into the post-processing device 7.

Processing by the post-processing section 8 is not limited particularly, but there are punch hole forming, folded-line forming, and the like. Further, as the recording material judging section 3, any section may be used as long as it can recognize size and thickness of the recording material S and judge whether the recognized size and thickness are the post-processing permissible size and thickness. For example, the recording material judging section 3 may, by recognizing automatically the size and the thickness of the recording material S used in the image forming apparatus 1, judge whether the recognized size and thickness are the post-processing permissible size and thickness, or may, by recognizing the size and thickness of the used recording material S on the basis of input information or operational information by a person, judge whether the recognized size and thickness are the post-processing permissible size and thickness. Further, from recording material supply sections for supplying the recording material S to the imaging section 2 of the image forming apparatus 1, a dedicated recording material supply section is determined, and the recording material judging section 3 may judge the recording material 8 to have the post-processing size and thickness which is supplied from this dedicated recording material supply section.

Further, the recording material S having the post-processing permissible size and thickness means a recording material except (i) a recording material S having the size which the post-processing device 7 can not transport and (ii) a recording material S having the size and thickness to which the post-processing is hardly subjected. For example, there are a recording material S having a size (transportable size) of B5 LEF (Long Edge Feed) length or more, and a recording material S having a basis weight of 220 gsm or less.

Next, the recording material judging section 3 will be described.

In a mode in which such the recording material judging section 3 is not provided, it is necessary that the post-processing device 7 handles all the recording materials S which are handled on the image forming apparatus.

For example, in order to make a recording material S of the usable minimum size in the image forming apparatus 1 usable in the post-processing device 7, it is necessary, so that the recording material S of the usable minimum, size can be transported, to set a pitch between transporting members narrow, and to form a transport path gently in consideration of rigidity of a recording material S having large basis weight (for example, recording material having a basis weight over 220 gsm).

However, in such the post-processing device 7, it has been confirmed that the recording material S usable in the image forming apparatus 1 does not coincides completely with the recording material S actually subjected to the post-processing in the post-processing device 7. Namely, regarding, for example, a postcard of B6 size or less, though the image formation can be certainly performed by New Year's card printing, hardly the postcard on which the image has been formed is immediately subjected to the post-processing such as punch hole forming or folding. Further, though the image formation can be performed on a thick envelope, hardly the envelope on which the image has been formed is immediately subjected to the post-processing such as punch hole forming or folding.

Thus, all the recording materials S usable in the image forming apparatus 1 are not subjected to the post-processing in the post-processing device 7, but at least a part of them is not subjected to the post-processing. On the basis of this fact, it is necessary to consider the recording material S not subjected to the post-processing as the specification of the post-processing device 7.

Therefore, in this exemplary embodiment model, a method is adopted in which the recording material judging section 3 distinguishes previously the recording material S having the post-processing permissible size and thickness in the post-processing device 7, of the recording materials S usable in the image forming apparatus 1 from the others thereof, and only the recording material S having the post-processing permissible size and thickness is supplied to the post-processing device 7.

Therefore, in this mode, since it is not necessary to transport the recording material S which is too small (for example, a minimum-sized recording material S in the image forming apparatus 1) as the specification of the post-processing device 7, it is possible to widen the pitch between the transporting members, so that the number of the transporting members is reduced. Further, since it is not necessary to transport the recording material which is too thick, even in case that a curved path which bends sharply is provided for a part of the transport path of the recording material S, it is possible to let the recording material S having comparatively low rigidity follow along the curved path, so that degree of freedom in layout of the transport path increases.

The number of recording material output portions on the image forming apparatus 1 side which is different from a recording material output portion 9 on the post-processing device 7 side in the exemplary embodiment model is not limited but may be any number, and the output direction of the recording material S is not also limited. On the other hand, the number of the recording material output portion 9 on the post-processing device 7 side is not particularly limited. For example, the recording material S which has received the processing in the post-processing section 8, and the recording material S which does not receive the processing in the post-processing section 8 may be output and accommodated onto the separate recording material output portions 9.

Further, in the exemplary embodiment model, from a viewpoint of downsizing the apparatus constitution and improving operability of taking out the output recording material S, the image forming apparatus 1 has an apparatus housing in which the imaging section 2 is built; a protruding portion 5 protruding upward is provided for a part of a top portion of this apparatus housing and an image reading device 6 for reading a document image is installed above this protruding portion 5; a space portion is formed between this image reading device 6 and the top portion of the apparatus housing except the protruding portion 5; the post-processing device 7 has a post-processing device housing which houses the post-processing section 8 therein; this post-processing device housing has a lateral-direction housing part which is arranged in the space portion, extending in the lateral direction and in a state where the upper area of the space portion is left; and a top portion of the lateral-direction housing part is used as a recording material output portion on the image forming apparatus 1 side. At this time, the image reading device 6 may be provided so as to be supported by the protruding portion 5, or may be constituted by a different body from a body of the protruding portion 5, and for example, may be provided on a rack.

Further, from a viewpoint of downsizing the post-processing device 7 and simplifying the internal constitution of the device 7, the post-processing device 7 may have a post-processing device housing which houses the post-processing section 8 therein; a transport path 7*a* through which the recording material S is transported is provided in this post-processing device housing; and a curved transport path so that the recording material S not having the post-processing permissible thickness cannot follow the other recording materials is bent-arranged as a part of this transport path 7*a*, and the post-processing section 8 is provided correspondingly to this curved transport path. In this case, the post-processing device 7 may has the curved transport path near an entrance of the transport path 7*a* in the post-processing device housing; and the post-processing section 8 functions as a punching section having a puncher that comes into contact with or separates from the curved transport path. Hereby, registration of the recording material S in the punching time can be performed on the basis of a leading end of the recording material S, so that the transport distance of the recording material S till the punching operation is performed can be reduced, skew (oblique feeding) of the recording material S which is easy to be produced in case that the transport distance is long can be reduced, and the member constitution can be simplified compared with the constitution which performs screw correction. Further, by arranging slantingly the punching section, even if the moving distance of a punching section (member which subjects actually the recording material S to the punching treatment in the punching section) in the substantially orthogonal direction to the punched surface of the recording material S is set long, the height in the vertical direction of the device can be suppressed, so that it is not necessary to heighten the position of the housing upper surface of the post-processing device 7. Further, regarding the bent-arrangement, the curved transport path may be bent or curved.

Particularly, in the mode in which the punching section as the post-processing section 8 is provided near the entrance in the post-processing device 7, the post-processing device 7 may have a punch controlling section for controlling a punching operation of the punching section; and this punch controlling section controls the punching section so that a punching position on the recording material S is determined on the basis of the distance from the lead edge position of the recording material S transported on the transport path 7*a* to perform the punching operation.

Further, from a viewpoint of degree of freedom in design in the post-processing device 7, plural transport members for giving transporting power to the recording material S may be provided along the transport path 7*a* in the post-processing device 7; and these transport members are arranged at intervals in which only the recording material S having the size judged to have the post-processing permissible size by the recording material judging section 3 can be transported.

Further, from a viewpoint of realizing the recording material processing apparatus which prevents mixed loading, at the recording material output portion 9 on the post-processing device 7 side, of the recording material S which has been subjected to the post-processing and the recording material S which does not receive the post-processing, the recording material processing apparatus may includes: an image forming apparatus 1 having an imaging section 2 for forming an image on a recording material S and a recording material output portion onto which the recording material S on which the image has been formed by this imaging section 2 is output and accommodated; a post-processing device 7 which is provided attached to this image forming apparatus 1, and has a post-processing section 8 which subjects a recording material S having post-processing permissible size and thickness to the predetermined post-processing selectively and a recording material output portion 9 onto which the recording material S after passing through the post-processing section 8 is output and accommodated; a recording material judging section 3 which judges whether the recording material S used in the image forming apparatus 1 is a recording material S having the post-processing permissible size and thickness; a post-processing selecting section which selects whether the post-processing is executed in relation to the recording material S to be used; and a recording material transport controlling section which, on the basis of a result of judgment by the recording material judging section 3, permits the recording material S for which the post-processing is selected by the post-processing selecting section, of the recording materials S judged to have post-processing permissible size and thickness, to be accepted in the post-processing device 7, and prohibits the recording material S judged to have the post-processing permissible size and thickness and the recording material S for which the post-processing is not selected, of the recording materials S judged to have the post-processing permissible size and thickness, from being accepted in the post-processing device 7.

Further, the invention can seize a point paying an attention to the thickness of the recording material S, and its point is as follows. Namely, the recording material processing apparatus may include: an image forming apparatus 1 having an imaging section 2 for forming an image on a recording material S and a recording material output portion onto which the recording material S having the image formed by this imaging section 2 is output and accommodated; a post-processing device 7 which is provided attached to this image forming apparatus 1, and has a post-processing section 8 which subjects a recording material S having post-processing permissible thickness to the predetermined post-processing selectively and a recording material output portion 9 onto which the recording material S after passing through the post-processing section 8 is output and accommodated; a recording material judging section 3 which judges whether the recording material S used in the image forming apparatus 1 is a recording material S having the post-processing permissible thickness; and; and a recording material transport controlling section 4 which, on the basis of a result of judgment by this recording material judging section 3, permits the recording material S judged to be have the post-processing permissible thickness to be accepted in the post-processing device 7, and prohibits the recording material S judged not to have the post-processing permissible thickness from being accepted in the post-processing device 7.

This invention will be described below more specifically on the basis of an exemplary embodiment shown in attached drawings.

Figure 2:
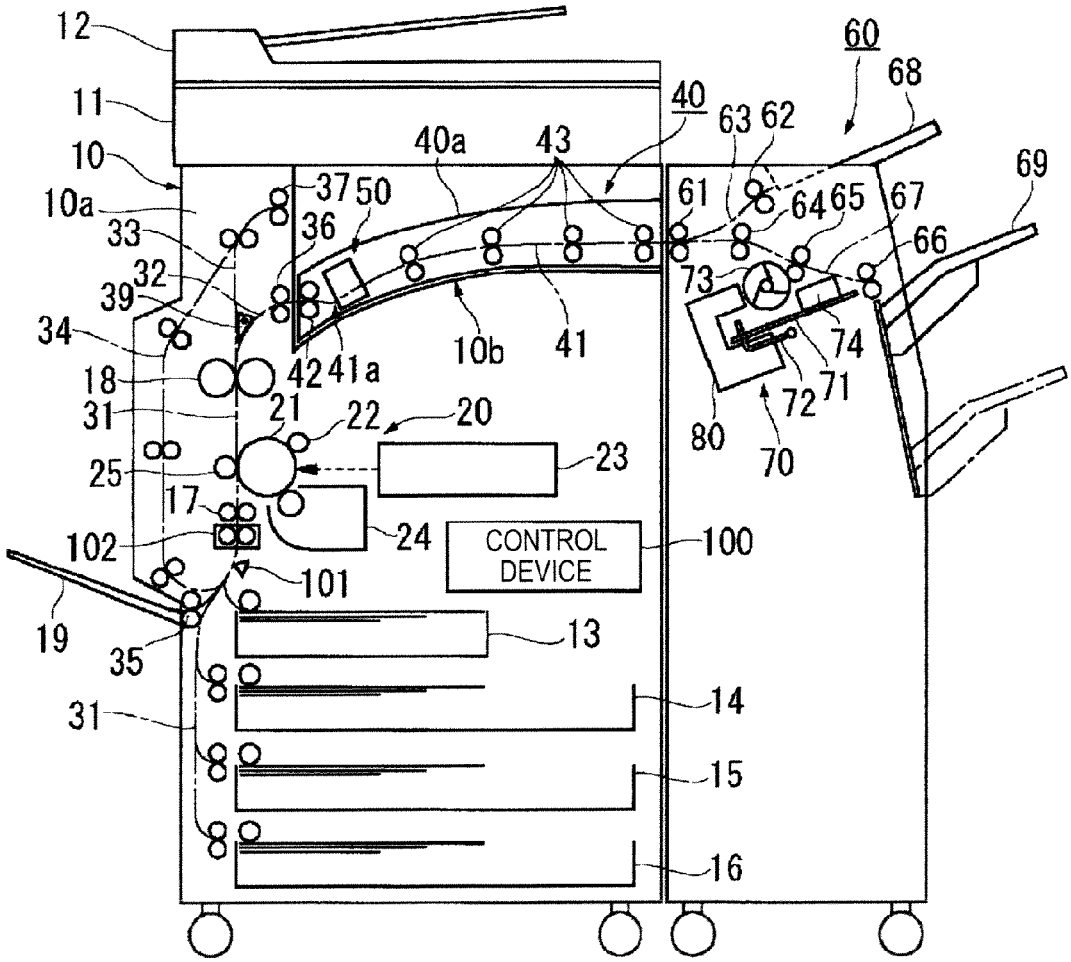
FIG. 2 is an explanatory view showing the outline of a recording material processing apparatus according to an exemplary embodiment of the invention.

FIG. 2 shows an exemplary embodiment of a recording material processing apparatus to which the above-described exemplary embodiment model is applied. In the figure, the recording material processing apparatus in this exemplary embodiment includes an image forming apparatus 10 capable of forming, for example, a monochromatic image on a recording material, and a post-processing device which is provided attached to this image forming apparatus 10 and includes two units. Further, the image forming apparatus 10 includes an apparatus housing which houses an imaging section 20 for forming an image on the recording material therein, a protruding portion 10*a* which is provided for a part of a top portion of the apparatus housing and extends upward, and an image reading device 11 for reading a document image which is provided above this protruding portion 10*a*. Therefore, a space portion is formed between the image reading device 11 and the top portion of the apparatus housing of the image forming apparatus 10 except the protruding portion 10*a*.

The post-processing device includes, at the top portion of the apparatus housing of the image forming apparatus 10 except the protruding portion 10*a*, as a post-processing section which subjects a recording material having post-processing permissible size and thickness to the post-processing, a punching unit 40 having a punching section 50 capable of punching holes in the recording material; and, on the side portion of the image forming apparatus 10, a stapling unit 60 which connects to the punching unit 40 and subjects the recording material to stapling treatment. Reference numeral 12 indicates an automatic document feeder 12 for feeding a document to the image reading unit 11.

The image forming apparatus 10 in the exemplary embodiment includes, at the upper portion in the apparatus housing, the imaging section 20 which forms a monochromatic image; and at the lower portion therein, four-stage recording material supplying sections 13 to 16 from which the recording materials are supplied. The imaging section 20 adopts, for example, an electrophotographic apparatus; and includes a photoconductor drum 21 on which a toner image is formed and held, a charger 22 such as a charge roil which charges this photoconductor drum 21, an exposure unit 23 such as a laser irradiation unit which forms an electrostatic latent image on the charged photoconductor drum 21, a development unit 24 which develops the electrostatic latent image formed on the photoconductor drum 21 with toner thereby to make the latent image visible, and a transfer unit 25 such as a transfer roll which transfers the toner image on the photoconductor drum 21 onto a recording material supplied from the recording material supplying section 13 to 16. In this example, of the recording material supplying sections 13 to 16, the recording material supplying section 13 located in the uppermost position accommodates a small-sized recording material.

Further, a recording material transporting apparatus in the image forming apparatus 10 is constituted as follows. In a vertical transport path 31 extending from the respective recording material supplying sections 13 to 16 upward in the substantially vertical direction, there are provided a registration roll 17 which positions and regulates the recording material supplied from each of the recording material supplying sections 13 to 16 and transports the recording material to the downstream side at predetermined timing, and a fixing unit 18 which fixes a not-fixed toner image transferred on the recording material transported from the registration roll 17.

Further, the vertical transport path 31 on the more downstream side than the fixing unit 18 is bifurcated by a switcher 39. One of the bifurcated paths is a first output path 32 connecting to a first output roll 36 which is located in the lower position in the protruding portion 10*a* and outputs the recording material from the image forming apparatus 10, and the other thereof is a second output path 33 connecting to a second output roll 37 which is located in the upper position in the protruding portion 10*a* and outputs the recording material from the image forming apparatus 10. Therefore, the recording materials which have passed through the fixing unit 18 are distributed by a switching operation of the switcher 39 so as to be transported to either the first output path 32 or the second output path 33.

Further, in the exemplary embodiment, in order to perform image formation on the both sides of the recording material, there is provided a return-transport path 34 for returning the recording material from the second output roll 37 side to the upstream side of the registration roll 17. Further, on the upstream side of the registration roll 17, there is provided a manual feeding supply section 19 which enables manual insertion of the recording material into the apparatus housing side of the image forming apparatus 10, and there is also provided a manual-feeding transport path 35 for transporting the recording material supplied from this manual-feeding supply section 19. On these transport paths, transport members (transport rolls and the like) for transporting the recording material and transport guide members are appropriately provided so as not to obstruct the transporting of the recording material.

In particular, in the exemplary embodiment, on the upstream side of the registration roil 17 of the vertical transport path 31, there are provided a size sensor 101 for detecting size of the transported recording material, and a thickness sensor 102 for detecting thickness of the recording material. On the basis of information from these sensors 101 and 102, a control device 100 judges the size and thickness of the transported recording material and controls the switcher 39, thereby to perform transport control of the recording material. The control device 100 in this example may simultaneously perform imaging control in the imaging section 20.

Figure 3:
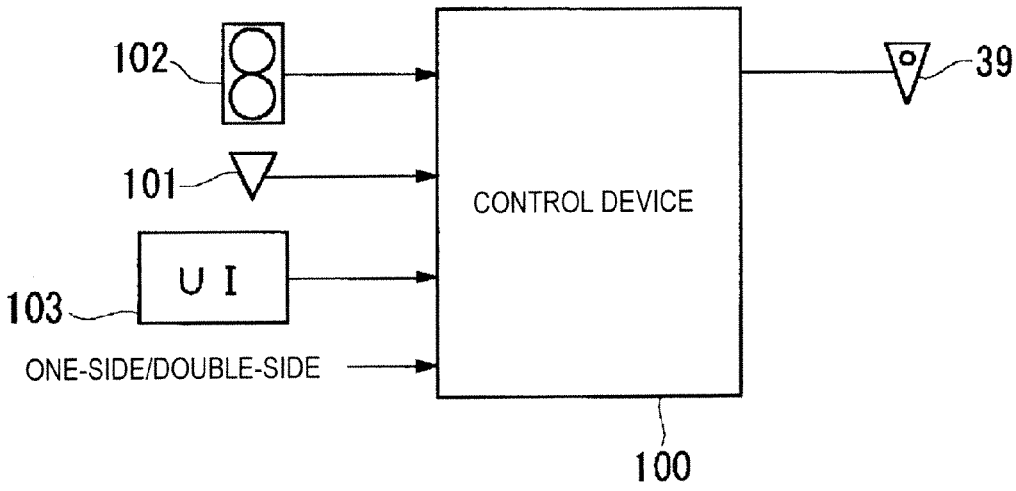
FIG. 3 is a block diagram showing a control apparatus in the exemplary embodiment.

FIG. 3 is a block diagram showing particularly an operation relating to the transport control of the recording material in the control device 100, in which the detection information from the size sensor 101 and the thickness sensor 102 are taken in the control device 100. Further, in the example, also from a UI screen (operational screen) 103 provided for the image forming apparatus 10, it is possible to input the size and the thickness of the used recording material. On the basis of these pieces of input information and recording information indicating whether an image to be recorded is a simplex image or a double-sided image, the control device 100 controls the switching operation of the switcher 39 and the transporting operation of the not-shown transport member.

As long as the size sensor 101 in the exemplary embodiment can detect the size (length in the transport direction) of the recording material, any sensor may be used. For example, by using a line sensor, the length in the width direction may be simultaneously detected. Further, the thickness sensor 102 detects the thickness from the resistance when the recording material is nipped between rolls, but the invention is not limited to this method. For example, an optical thickness sensor may be utilized. Further, without using the size sensor 101 and the thickness sensor 102, the operator may perform the manual input of the size and thickness from the UI screen 103, and the control device 100 may judge the size and thickness of the recording material to be used on the basis of the input data.

Furthermore, when supplying a recording material below a predetermined size or a recording material above a predetermined thickness, the recording material supplying section 13 may be dedicated so that only the recording material supplying section 13 handles such the recording material. In this case, when this recording material supplying section 13 is used, the control device 100 judges that the recording material below predetermined size or the recording material above the predetermined thickness is used. Alternatively, using the manual-feeding supply section 19 in place of the recording material supplying section 13, the similar judgment may be performed.

On the other hand, as shown in FIG. 2, in the punching unit 40 which is directly mounted in the space portion between the imaging section 20 of the image forming apparatus 10 and the image reading device 11 and on the recording material output portion 10*b* of the top portion of the apparatus housing which houses the imaging section 20 therein, a transport path 41 in which the recording material is transported is provided in the housing, a curved transport path 41*a* arranged in a curved state is provided on the entrance side of a part of this transport path 41, and the punching section 50 is provided correspondingly to this curved transport path 41*a*. Further, the entrance-side opening portion of this punching unit 40 is provided correspondingly to the first output roll 36 of the image forming apparatus 10, and the recording material on which the image has been formed in the image forming apparatus 10 is transported through this first output roll 36 into the punching unit 40.

Further, in the punching unit 40, the upper housing portion thereof (corresponding to 40*a*) functions as a recording material output section 40*a* which accommodates the recording material output from the second output roll 37 of the image forming apparatus 10, and the recording material can be accommodated sufficiently in the space area between the recording material output section 40*a* and the image reading device 11 located above. Further, in the punching unit 40, an entrance roll 42 for carrying the recording material in the punching unit 40 is provided on the entrance side, and transport rolls 43 for feeding the recording material to the stapling unit 60 are appropriately provided at predetermined intervals.

Figure 4:
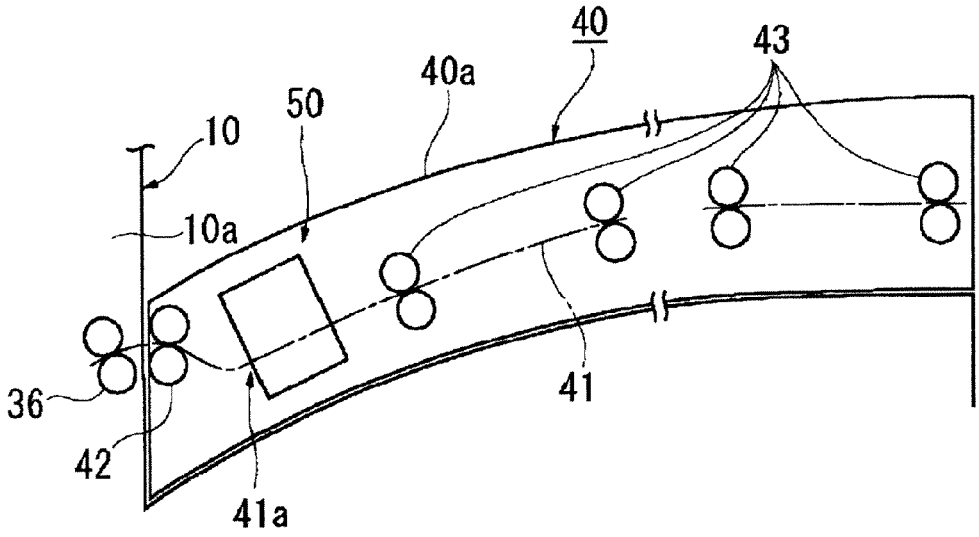
FIG. 4 is an enlarged view of a punching unit in the exemplary embodiment.

FIG. 4 is an enlarged view of the punching unit 40. The curved transport path 41*a* is formed substantially in the V-shape which once slants downward from the entrance of the punching unit 40 along the recording material transporting direction and thereafter extends upward, and the punching section 50 is arranged correspondingly to this curved transport path 41*a*. The punching section 50 is provided near the entrance of the punching unit 40 so as to perform directly the punching operation to the recording material output from the first output roll 36 of the image forming apparatus 10. Further, this punching section 50, in order to make the height of the punching unit 40 low, is arranged in a slightly slanting state from the vertical direction to the protruding portion 10*a* side of the image forming apparatus 10. Therefore, near the entrance of the punching unit 40, the transport path 41 of the recording material becomes the curved transport path 41*a* which bends greatly, and the recording material output from the first output roll 36 of the image forming apparatus 10 to the punching unit 40, till being set in the punching section 50, is necessarily transported on this curved transport path 41*a*, so that the curved transport path 41*a* is a path which is difficult to transport a thick recording material.

Figure 5A:
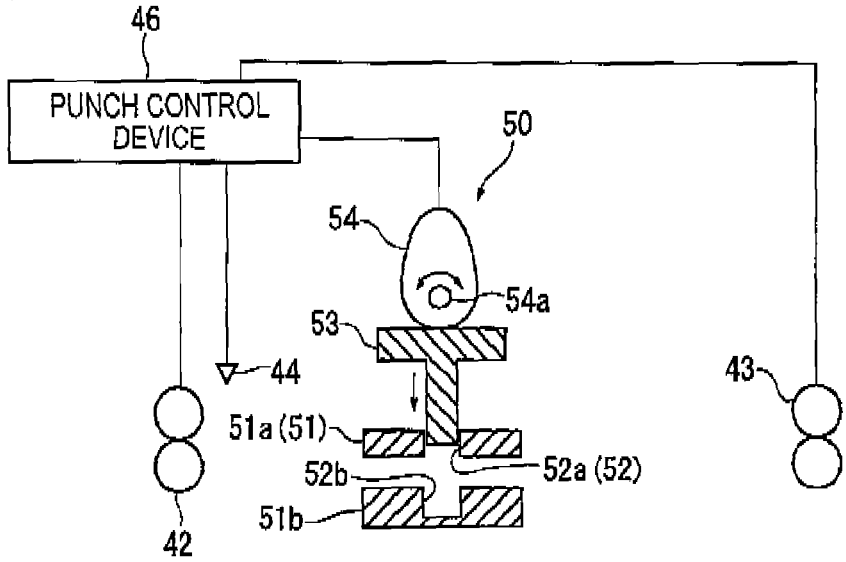
FIG. 5A is an explanatory view in the constitution in which punch control is performed by a punching section, showing a state in which the punching section is waiting.

In the punching unit 40 in the exemplary embodiment, as shown in FIG. 5A, various controls are per formed by a punch control device 46. Namely, in the exemplary embodiment, a sensor 44 for detecting leading-end passage information of the recording material is provided along the transport path 41 (refer to FIG. 4) located on the more upstream side than the punching section 50. On the basis of this passage information, the punch control device 46 controls the entrance rolls 42, the punching section 50, and the transport rolls 43. This figure is schematically shown, in which the transport path 41 is shown substantially in the linear shape.

Further, the punching section 50, in which the transport path of the recording material is provided between two upper and lower members 51*a* and 51*b*, includes a punch base 51 having hole portions 52 (52*a*, 52*b*) of the substantially same diameter striding between these two members 51*a* and 51*b*, a puncher 53 which can move freely in the hole portions 52 of this punch base 51 up and down along the hole walls, a cam 54 which rotates around a rotary shaft 54*a* arranged offset thereby to move the puncher 53 up and down, and a drive apparatus which drives this cam 54. Further, the puncher 53 is always urged upward in the figure by a not-shown urging member such as a spring so as not to hinder the recording material from passing through the punch base 51. Further, in the punching unit 40, the punching section 50 is arranged so that the moving direction of the puncher 53 slants from the vertical direction to the entrance side (refer to FIG. 4).

When holes are punched in the recording material by means of such the punching section 50, a recording material of which the lead edge position has been detected by the sensor 44 which detects leading-end passage timing of the recording material is transported by rotation of the entrance rolls 42 for a predetermined time thereby to be transported to the punching section 50. Namely, after the recording material has passed through the sensor 44, the entrance rolls 42 are stopped at the predetermined timing, whereby the recording material is transported to the predetermined position of the punching section 50 and stopped. Therefore, in a position corresponding to a predetermined distance from the lead edge of the recording material, the puncher 53 of the punching section 50 is positioned.

Figure 5B:
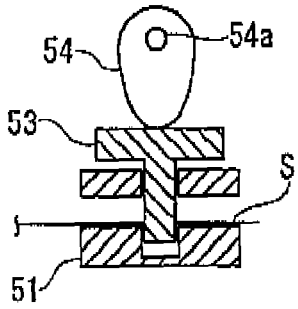
FIG. 5B is an explanatory view showing a state in which the punching section has performed the punching treatment for the recording material.

Next, the cam 54 is rotated around the rotary shaft 54*a* by the not-shown drive system, whereby the puncher 53 descends toward the punch base 51 as shown in FIG. 5B, and the recording material which is stopped on the punch base 51 is subjected to the punching treatment. Since the hole portion 52*b* of the lower member 51*b* of the punch base 51 has the substantially same shape as the shape of the puncher 53, needless to say, this hole portion 52*b* becomes a punching die at this time. Further, the shape of the hole portion 52*b* is not limited particularly, but may be round or square.

In this exemplary embodiment, although the entrance roll 42 and the sensor 44 are provided in the punching unit 40, a sensor for detecting leading-end passage of the recording material may be provided, for example, on the image forming apparatus 10 side; and by controlling the transport distance of the recording material by the first output roll 36, the recording material may be located in the punching position.

Further, in the exemplary embodiment, although the punch base 51 does not move, when the puncher 53 descends toward the punch base 51, the upper member 51*a* of the punch base 51 may descend thereby to press the recording material in the punching operation time for the recording material by the puncher 53. Such the constitution can be realized by further installing an urging member such as a spring between the puncher 53 and a sub-frame of the punching unit 40. As soon as the puncher 53 descends by the cam 54, the urging member between the puncher 53 and the upper member 51*a* of the punch base 51 presses the member 51*a*, and then the member 51*a* descends together with the puncher 53, so that the recording material can be clamped between the members 51*a* and 51*b*. Therefore, in the punching time for the recording material, the posture of the recording material can be stabilized, so that the punching operation which is more stable can be performed.

Thus, in the punching section 50, when the punching operation is performed to the recording material, since the members move very much in the direction orthogonal direction to the recording material surface (specifically, in the up-down direction), the size of the punching section 50 itself requires a long occupation length in its direction. Namely, though the enough height in the up-down direction is required in the vicinity of the punching section 50 of the punching unit 40, since the punching section 50 is slantingly arranged in the exemplary embodiment, the height of the punching unit 40 can be suppressed.

Here, the layout of the punching section 50 will be described.

Figure 6A:
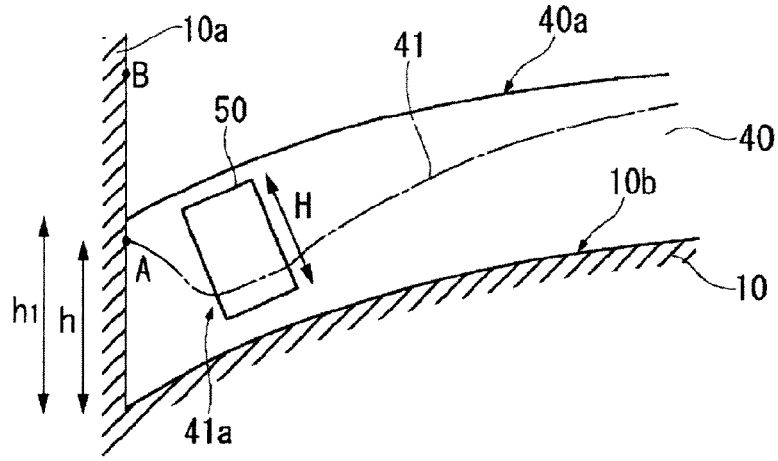
Figure 6B:
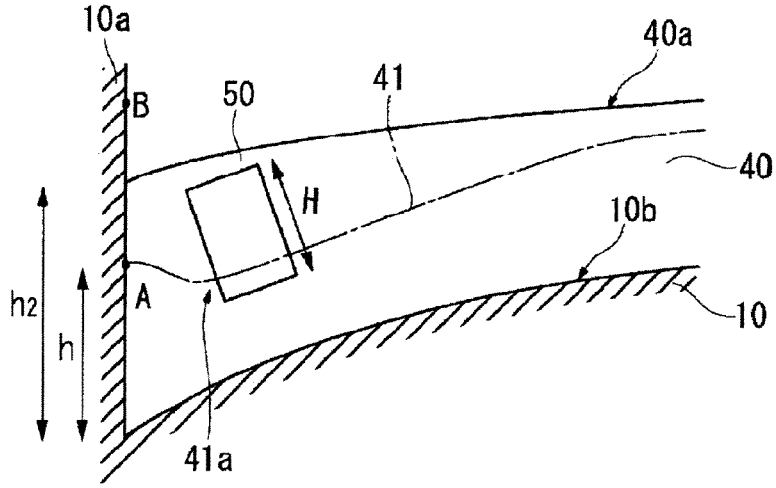
Figure 6C:
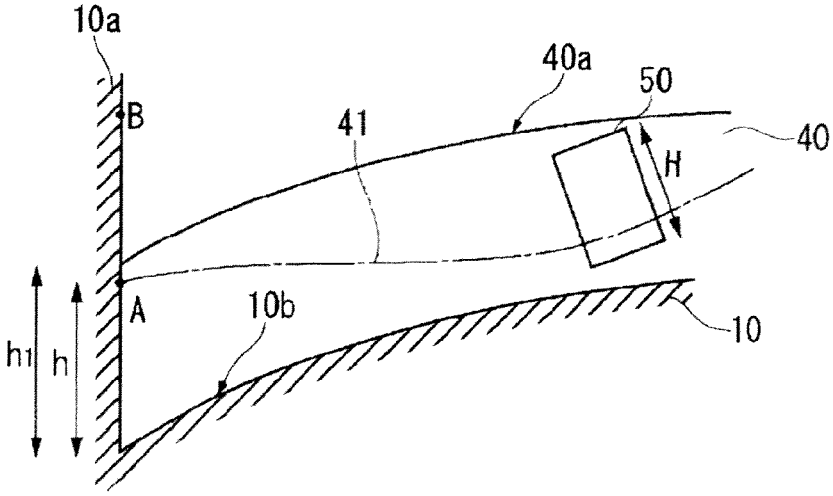

FIGS. 6A to 6C show the layouts of the punching section 50 when the punching unit 40 is provided on the image forming apparatus 10, in which FIG. 6A shows the exemplary embodiment of the invention in which the punching section 50 is provided on the entrance side and the largely curved transport path 41*a* is formed, FIG. 6B shows a first comparison model in which the curving degree of the curved transport path 41*a* is alleviated, and FIG. 6C shows a second comparison model in which the punching section 50 is provided on the back side of the transport path 41. Namely, in the exemplary embodiment, as shown in FIG. 6A, the punching section 50 is brought close to the recording material output portion 10*b* of the image forming apparatus 10, and wide space is secured above the punching unit 40. On the other hand, in FIG. 6B, in order to alleviate the curving degree of the curved transport path 41*a*, the punching section 50 is arranged above.

In such the arrangement, usually, in case that the recording material is output from the protruding portion 10*a* of the image forming apparatus 10 to the recording material output portion 10*b* on the image forming apparatus 10 side, a position A of an output port provided for the protruding portion 10*a*, considering the recording material output capacity onto the recording material output portion 10*b*, is set to a degree of height h. If the height h of this position A is set low, in case that the punching unit 40 is arranged, the transport path 41 of the recording material is set gently. However, in case that there is no punching unit 40, in the discharging time onto the recording material output portion 10*b*, there is fear that the loading amount of the recording materials is not gained, or that the previous recording material is pushed by a recording material succeedingly output thereby to cause poor accommodation property of recording material onto the recording material output portion 10*b*.

On the other hand, in case that the height h of the position A in the protruding portion 10*a* is set low and the punching unit 40 is not provided, it is also assumed that the recording material is output from only a position B of an output port located at the upper portion of the protruding portion 10*a*. However, in this case, the fall distance up to the recording material output portion 10*b* becomes too long, so that there is fear that the edges of the recording materials accommodated onto the recording material output portion 10*b* are not aligned. Accordingly, the position A of the discharge exit is provided at a degree of height h.

Further, in case that the punching unit 40 is provided, since the upper housing portion of this punching unit 40 is used as the recording material discharge portion 40*a*, it is necessary to suppress a height $h_1$ of its unit itself. In this exemplary embodiment, as shown in FIG. 6A, by providing the punching section 50 in the low position, the height $h_1$ can be suppressed; and by leaving the wide space above the punching unit 40, it is possible to secure the enough accommodation property of the recording materials output from the position B of the output port to the recording material discharge portion 40*a*. Further, by arranging the punching section 50 slantingly, it is not necessary to make the height of the recording material discharge portion 40*a* of the punching unit 40 vainly high. However, from such the contrivance the curved transport path 41*a* is generated.

To the contrary, as shown in FIG. 6B, in order to make the curved transport path 41*a* gentle, in case that the punching section 50 is lifted upward, the curved transport path 41*a* is surely made gentle, and the transporting ability of the recording material is improved. However, a height $h_2$ on the entrance side of the punching unit 40 becomes high, and the recording material discharge portion 40*a* of the punching unit 40 is located above, so that the accommodation property of the recording materials in this section 40*a* lowers (the loading amount becomes insufficient).

Further, in order to enhance the recording material accommodating property of the recording material discharge portion 40*a*, in case that the punching section 50 is arranged on the back side of the punching unit 40 as shown in FIG. 6C, it is possible not to form the curved transport path in the transport path 41, and the height $h_1$ on the entrance side of the punching unit 40 can be suppressed. However, the transport distance of the recording material in the punching unit 40 is too long, so that in the punching operation by the punching section 50, it is necessary to correct skew of the recording material, with the result that many members are required.

In the exemplary embodiment, since the punching section 50 is slantingly arranged on the entrance side of the punching unit 40, the recording material transported to the punching unit 40 is not transported at an unnecessarily long distance. Therefore, it is not necessary to correct the skew of the recording material in the punching time, and a mechanism for skew correction is not required. Further, the height of the portion of the punching unit 40 in which the punching section 50 is arranged is not made vainly large, with the result that it is possible to hold the wide space between the punching unit 40 and the image reading device 11. At the portion where the punching section 50 is arranged, the curved transport path 41*a* is generated. However, in such the curved transport path 41*a*, though transporting of the thick recording material can be obstructed, there is no fear that transporting the thin recording material is obstructed. In this example, it is difficult for a recording material having a basis weight 220 gsm or more to pass through the curved transport path 41*a*.

Further, in the punching unit 40 in the exemplary embodiment, since the entrance rolls 42 and the transport rolls 43 which are arranged inside are spaced at wide intervals (refer to FIG. 4), the size (length in the transport direction) of the transportable recording material is limited. In particular, in this example, the entrance roll 42 and the transport rolls 43 are arranged at such intervals that a recording material of A4-LEF (Long Edge Feed) size is transportable and a recording material below B5-LEF size is not transportable.

Furthermore, since the recording material having a basis weight 220 gsm or more is not transported to the punching unit 40, even in case that the curved transport path 41*a* is generated from the punching section 50 arranged slantingly in the transport path 41 of the recording material, as long as the thick recording material is not transported, there is no obstacle to transport the recording material.

Next, the stapling unit 60 will be described. The stapling unit 60, as shown in FIG. 2, is arranged at the side portion of the image forming apparatus 10, and includes therein an edge stapling part 70 which stacks plural sheets of the recording materials transported from the punching unit 40, and can perform an edge-stapling operation of driving a staple into end portions of the sheets.

Therefore, the stapling unit 60 includes an entrance roll 61 through which the recording material transported from the punching unit 40 is received in the unit 60. The transport path of the recording material branches at this entrance roll 61 in two directions on the downstream side in the recording material transporting direction, of which one branch is a first transport path 63 toward a discharge roll 62 and the other branch is a second transport path 67 toward transport rolls 64 to 66.

The first transport path 63 is a path of, without processing the recording material transported from punching unit 40 by the edge stapling part 70, transporting its recording material to a recording material discharge portion 68 provided for a housing upper portion of the stapling unit 60, while the second transport path 67 is a path of transporting the recording material to a movable recording material discharge portion (so-called offset catch tray) 69 which is provided for the side portion of the stapling unit 60.

Further, the edge stapling part 70 provided below the second transport path 67 includes an edge stapler 80 which staples a set of recording materials, a guide receiver 71 which guides the recording material, a stop plate 72 which regulates a back end of the recording material on this guide receiver 71, an alignment transport member 73 which aligns the recording materials on the guide receiver 71 while return-transporting them toward the stop plate 72, and an alignment member 74 which aligns side edges of the set of recording materials on the guide receiver 71.

Figure 7:
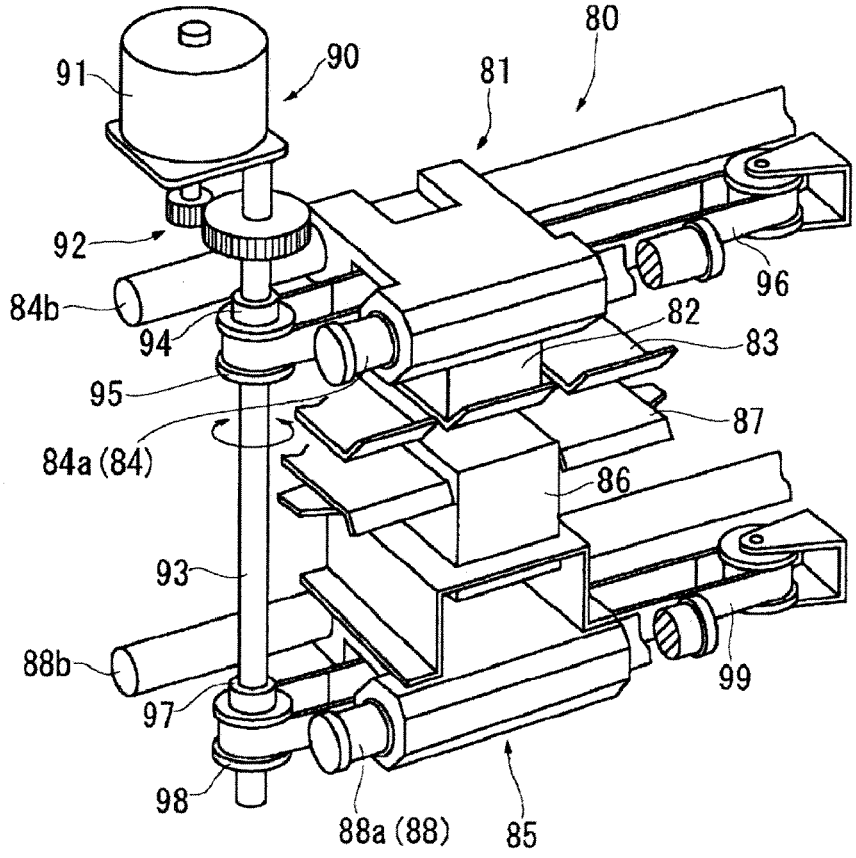
FIG. 7 is an explanatory view showing an edge stapler in a stapling unit.

In the edge stapler 80 in the exemplary embodiment, as shown in FIG. 7, an upper stapling member 81 and a lower stapling member 85 are provided so as to hold the upper and lower sides of the recording material set of which the back end position is regulated by the stop plate 72 (refer to FIG. 2) and which is aligned. In the exemplary embodiment, the lower stapling member 85 having a drive member 86 which drives staples is so constructed as to be capable of sliding along a guide bar 88 (88*a*, 88*b*). Therefore, a belt member 99 for driving the lower stapling member 85 is provided.

On the other hand, in the upper stapling member 81 located over the recording material, there is provided a bending member 82 which bends legs of a staple to staple the recording materials. Further, the upper stapling member 81 is so constructed as to be capable of sliding along a guide bar 84 (84*a*, 84*b*) for guiding the upper stapling member 81, and driven by a belt member 96.

Further, in the upper stapling member 81 and the lower stapling member 85, guide plates 83 and 87 for guiding the set of recording materials between their members are arranged respectively, and perform a guide operation for the set of recording materials aligned on the basis of the back end position of the recording material by the stop plate 72.

Further, in order to slide the upper stapling member 81 and the lower stapling member 85 along their respective guide bars 84 and 88, a drive device 90 is arranged, and the rotation of a motor 91 is transmitted through a gear train 92 to a rotational shaft 93. At the upper portion of the rotational shaft 93, a pulley 95 is arranged through a clutch 94, and drive of the belt member 96 is performed through this pulley 95 thereby to move the upper stapling member 81. On the other hand, at the lower portion of the rotational shaft 93, a pulley 98 is provided through a clutch 97, and by driving the belt member 99 by means of this pulley 98, the lower stapling member 85 can move integrally with the upper stapling member 81. At this time, the motor 91 is constituted by, for example, a stepping motor which is rotatable in forward and reverse directions, whereby the upper stapling member 81 and the lower stapling member 85 are moved in the predetermined direction and at the predetermined distance thereby to be located in the stapling position of the set of recording materials, and the stapling operation using staples can be performed.

Therefore, as shown in FIG. 2, since the transport roll 66 is constituted in a separable way, the recording material transported on the second transport path 67 falls on the guide receiver 71 at a stage when the recording material back end has passed through the transport roll 65 adjacent to this transport roll 66 on the upstream side. Next, the alignment transport member 73 comes into pressure contact with the recording material, whereby by the action of the alignment transport member 73, the back end of the recording material is positioned at the stop plate 72; and by the action of the alignment member 74, the side end position of the recording material is also regulated. After such the operation has been repeated in relation to the plural sheets of recording materials, the set of plural aligned recording materials is stacked on the guide receiver 71. Thereafter, the set of recording materials edge-stapled by the edge stapler 80, by transport rolls 66 nipping the set of recording materials, is output and accommodated onto the recording material discharge portion 69 on the downstream side.

Next, referring mainly to FIG. 2, the operations of the image forming apparatus 10, the punching unit 40 and the stapling unit 60 in this exemplary embodiment will be described, attaching importance to a transport state of the recording material.

In the image forming apparatus 10, a recording material supplied from any section selected from the recording material supplying sections 13 to 16 is position-regulated by the registration roll 17, and transported at the predetermined timing to the transfer portion (portion where the transfer unit 25 and the photoconductor drum 21 are opposed to each other), whereby a toner image on the photoconductor drum 21 is transferred onto the recording material. A non-fixed toner image transferred onto this recording material is transported through the vertical transport path 31 to the fixing unit 18 and fixed. The recording material after image-fixing is distributed according to the switching operation by the switcher 39 to the first discharge path 32 extending toward the punching unit 40 side, or the second discharge path 33 extending toward the recording material discharge portion 40*a* on the punching unit 40.

Here, in case that the second discharge path 33 has been selected, the recording material is output directly from the second discharge roll 37 to the recording material discharge portion 40*a* on the punching unit 40. Further, in case that double-sided recording is performed on the recording material, the second discharge roll is reversed under a condition where the portion in the vicinity of the back end of the recording material of which one surface has been already subjected to recording is nipped by the second discharge roll 37, the recording material is returned to the registration roll 17 through the return-transport path 34, a new image is formed on a rear surface of the recording material, and thereafter the recording material is transported to the predetermined transport path.

On the other hand, in case that the first discharge path 32 is selected by the switcher 39, the recording material is transported through the first discharge roll 36 to the punching unit 40.

In the punching unit 40, in case that the punching treatment is performed, the recording material in a stopped state by the first discharge roll 36 is subjected to the punching treatment, and thereafter the recording material subjected to the punching treatment is transported in the downstream direction and transported to the stapling unit 60 side (refer to FIG. 6A and the like). In case that the punching treatment is not performed, the recording material is transported directly to the stapling unit 60 side.

The recording material transported to the stapling unit 60, in case that the edge stapling treatment is not performed, is transported through the first transport path 63 in the stapling unit 60 to the upper recording material discharge portion 68. On the other hand, in case that the edge stapling treatment is performed, the recording material is fed through the second transport path 67 onto the guide receiver 71, and the back end of the recording material is regulated by the stop plate 72. Thereafter, this operation is repeated in relation to the predetermined number of sheets, a set of the predetermined number of sheets of recording materials are aligned on the guide receiver 71, and thereafter the set of recording materials is subjected to the edge-stapling treatment by the edge-stapler 80. The set of recording material subjected to the edge-stapling treatment is nipped by the transport rolls 66, and thereafter output to the movable recording material discharge portion 69 side. This recording material discharge portion 69, as the sets of recording material are stored thereon, moves downward as it is, so that the recording material discharge portion 69 can accommodate many sets of recording materials therein.

Figure 8:
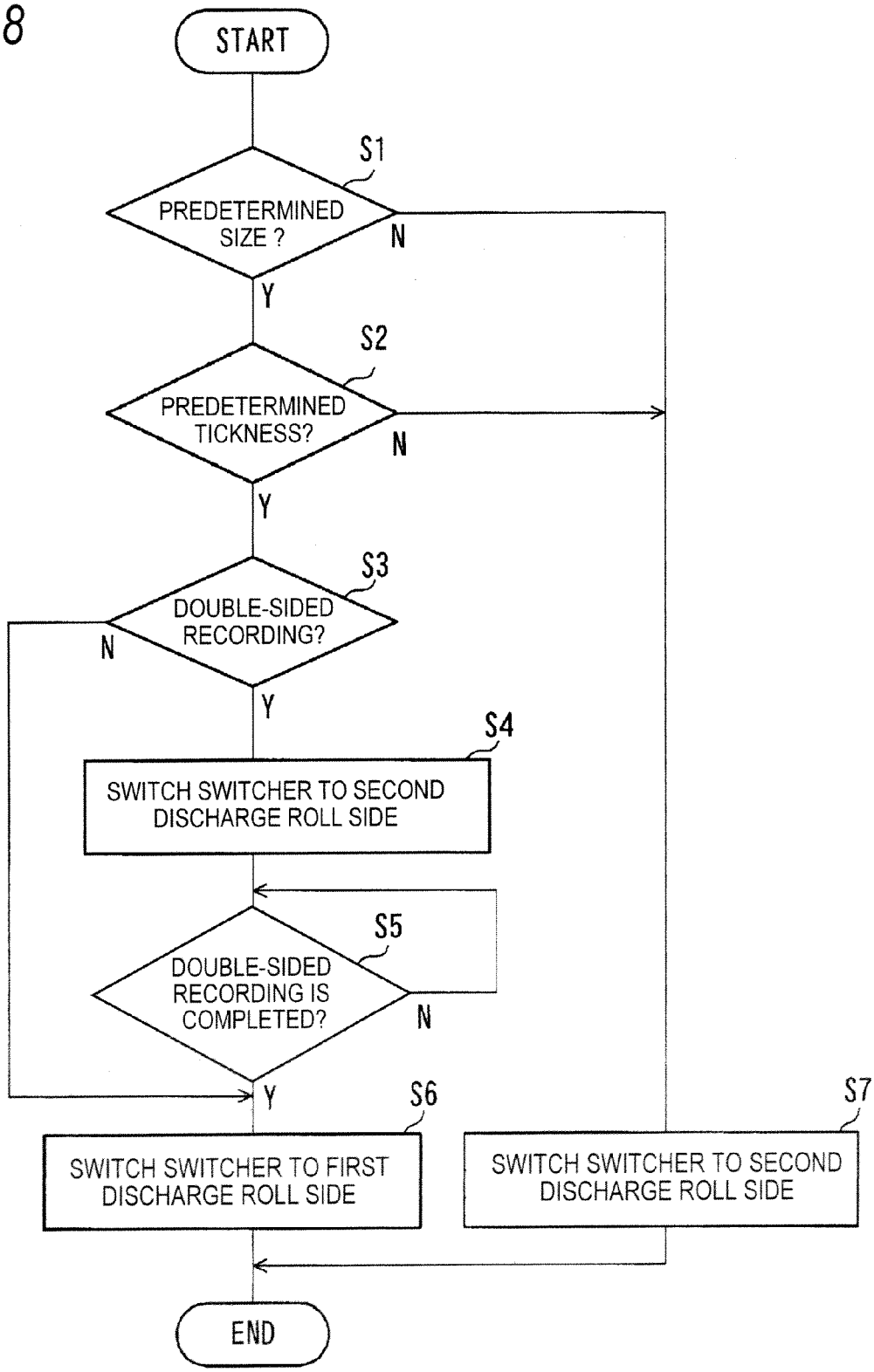
FIG. 8 is a flowchart showing transport control of recording material in the exemplary embodiment.

In such the working, in particular, the exemplary embodiment is characterized by transport control of recording material in the image forming apparatus 10. The transport control of recording material in the image forming apparatus 10 is shown in a flowchart of FIG. 8. Here, this flowchart will be described with reference to FIG. 2.

First, as a recording material is supplied from any of the recording material supplying sections 13 to 16 to the vertical transport path 31, size information and thickness information of the recording material are detected every time the recording material passes through the size sensor 101 and the thickness sensor 102. The control device 100, on the basis of these information, performs switching by the switcher 39, and selects a destination of discharge of the recording material.

Therefore, whether or not the size of the recording material is equal to or larger than a predetermined size previously specified is judged (step S1). In case that the size of the recording material is judged to be equal to or larger than the predetermined size, whether or not the thickness thereof is equal to or smaller than a predetermined thickness is next judged (step S2). In case that the thickness is judged to equal to or smaller than the predetermined thickness, whether recording is two-sided recording or one-sided recording is next judged (step S3). At this time, in case that recording is judged to be the two-sided recording, the switcher 39 is switched to the second discharge roll 37 side (step S4: the transport control enables the recording material to proceed to the second discharge roll 37 side). Thereafter, whether or not this both-sided recording is completed is judged (step S5). In case that the both-sided recording has been completed (at appropriate timing on and after a point of time when the recording material of which one side has recording has passed through the switcher 39), the switcher 39 is switched to the first discharge roll 36 side (step S6). Further, in case that recording is judged to be not the two-sided recording in the step S3, the switcher 39 is switched to the first discharge roll 36 side (step S6), and output is completed.

By thus performing the transport control, in case that the used recording material has the predetermined size or more, and the predetermined thickness or less, it is output from the first discharge roll 36 side to the punching unit 40.

Further, in case that the used material is judged to have the size smaller than the predetermined size in the step S1, or judged to have thickness over the predetermined thickness in the step S2, the switcher 39 is switched to the second discharge roll 37 side (step S7), and output is completed.

By thus performing the transport control, in case that the used recording material has the size smaller than the predetermined size or has the thickness over the predetermined thickness, it is output from the second discharge roll 37 side.

For example, when the predetermined size is taken as a size of B5 LEF (Long Edge Feed), and the predetermined thickness is taken as a basis weight of 220 gsm, all of the recording materials having the size below the B5 LEF length and the recording materials having the thickness of the basis weight over 220 gsm are not transported to the punching unit 40 side.

Therefore, it is possible to avoid a bad effect in case that such the recording materials have been transported to the punching unit 40 side, that is, a condition in which satisfactory transportation is not executed due to intervals of the transport members and curvature of the transport path. Further, since usually such the small-sized recording material and the thick recording material are hardly subjected to the post-processing, these recording materials are output onto the upper housing portion (corresponding to 40*a*) of the punching unit 40, whereby time from image formation onto the recording material to discharge of the recording material can be also reduced.

Even if such an instruction of subjecting the small-sized recording material or the thick recording material to the post-processing is given, since the size and thickness of the used recording material are judged by the control device 100, such the used recording material is never output to the punching unit 40 side.

Here, the influence by the size and thickness of the recording material will be intelligibly described with reference to figures.

Figure 9A:
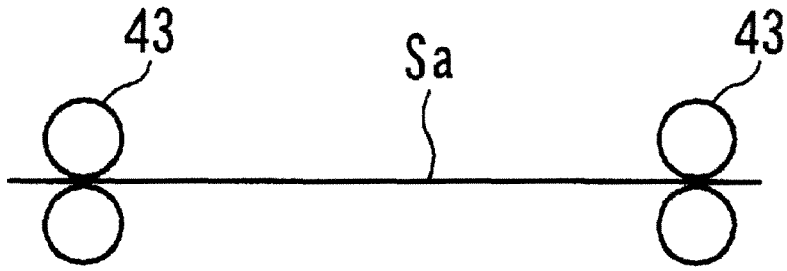
FIG. 9A and FIG. 9B are explanatory views showing a recording material size and intervals of transport rolls.
Figure 9B:
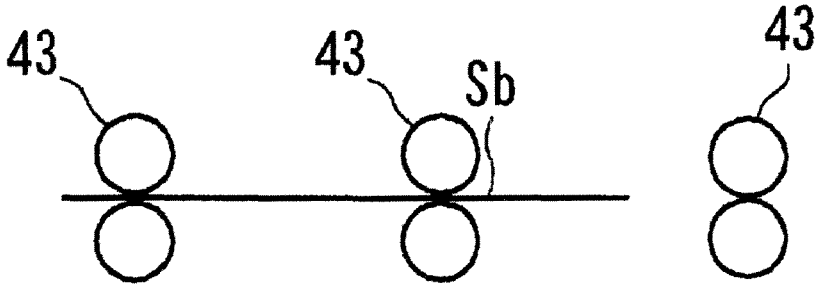
Figure 10A:
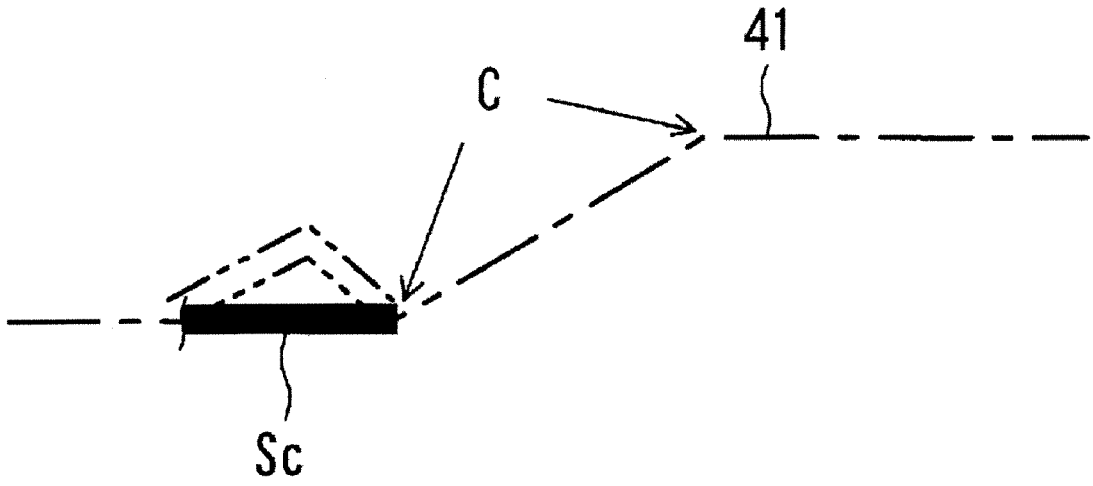
FIG. 10A and FIG. 10B are explanatory views showing a relation between the thickness of recording material and a transport path having a curved portion.
Figure 10B:
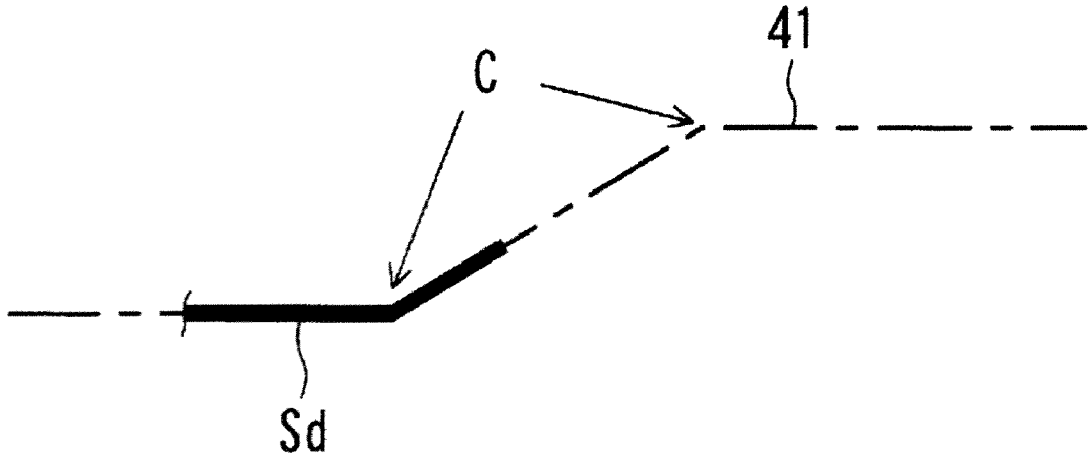

FIGS. 9A and 9B show an arrangement interval of the transport rolls 43 on the basis of the size (length in the transporting direction) of the recording material. In case of a large-sized recording material Sa as shown in FIG. 10A, the number of the transport rolls 43 to be installed can be correspondingly reduced, while in case of a small-sized recording material Sb as shown in FIG. 10B, it is necessary to increase the number of the transport rolls 43 to be installed. Therefore, in FIG. 10B, not only member cost of the transport roll 43 is required more but also the degree of freedom in layout is smaller than in FIG. 10A.

Further, since generally the small-sized recording material Sb is hardly subjected to the post-processing such as punching treatment or edge-stapling treatment, there is hardly an obstacle to switching of the discharge path according to the size as in the exemplary embodiment.

Further, FIGS. 10A and 10B shows a state of the transport path 41 which is transportable according to the thickness of recording material. In case that a curved portion C (corresponding to the curved transport path 41*a*) exists in the transport path 41, when a thick recording material Sc will be transported as shown in FIG. 10A, the recording material Sc is caught at the curved portion C; and when the recording material Sc will be further transported, there is fear that buckling as shown by a chain double-dashed line in the figure will be produced in the recording material Sc and the recording material Sc will bend. On the other hand, in case that a thin recording material Sd will be transported as shown in FIG. 10B, even in case that the curved portion C exists, there is no problem that the recording material Sd is caught or bends. Therefore, by not guiding the thick recording material Sc to such the transport path 41, damage is not caused for the thick recording material Sc. Further, since generally the thick recording material Sc is hardly subjected to the post-processing such as the punching treatment or the edge stapling treatment, there is hardly an obstacle to switching of the discharge path according to the thickness as in the exemplary embodiment.

In the exemplary embodiment, though the discharge path of recording material branches off in two directions, the invention is not limited to this, but the second discharge path 33 may further branch off in two directions. For example, a branch path of the second discharge path 33 may lead to side wall side (the side opposite no the post-processing device) of the image forming apparatus 10.

Further, though the mode in which the imaging section 20 forms a monochromatic image is shown, a mode in which the imaging section 20 forms a color image may be adopted. Further, though as the post-processing device, the punching unit 40 and the stapling unit 60 are provided, these units may be integrated, or only the punching unit 40 may be provided. In case that only the punching unit 40 is provided, needless to say, the recording material discharge portion is provided on the exit side of the punching unit 40.

Figure 11:
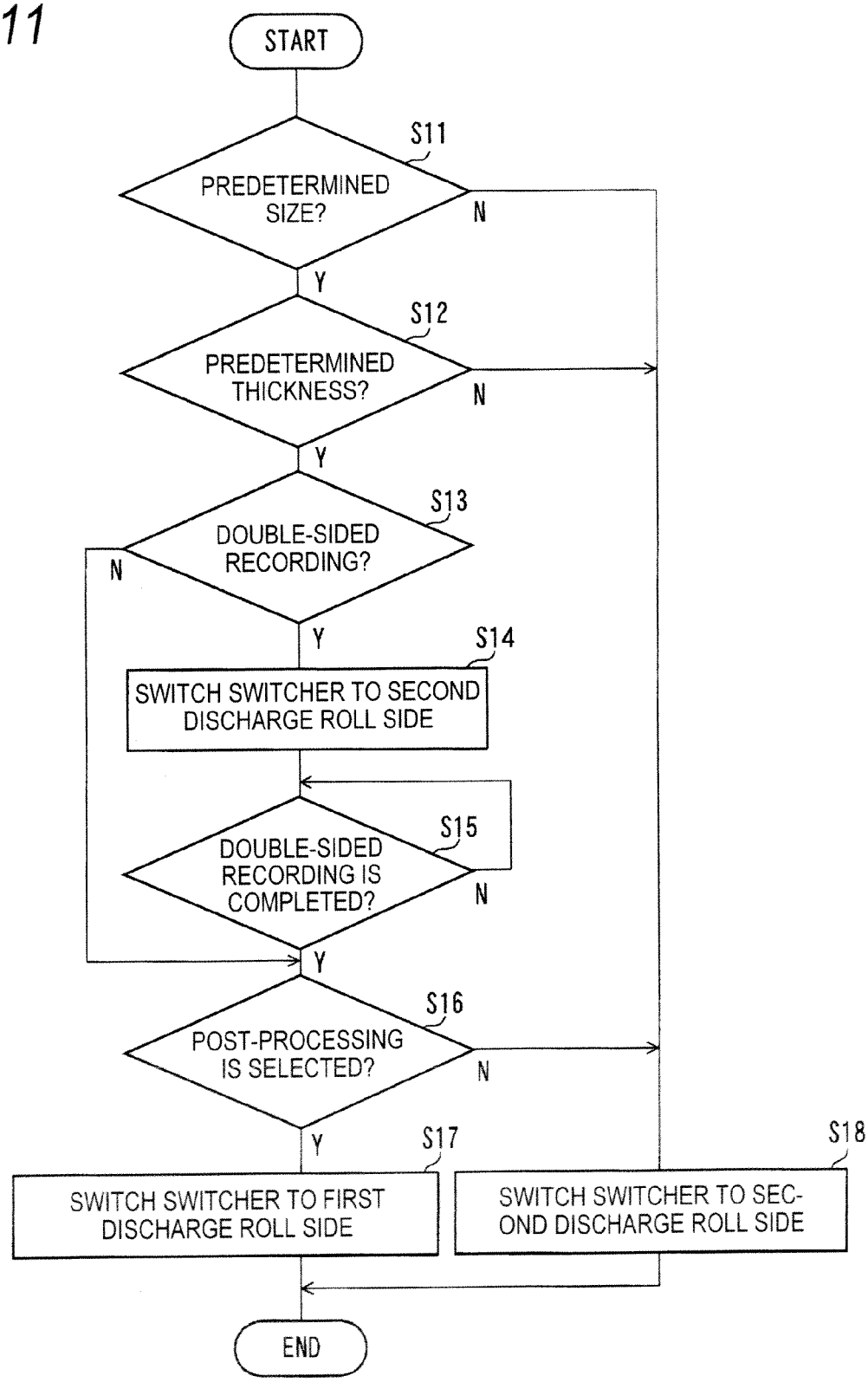
FIG. 11 is a flowchart showing transport control of recording material in a modified example.

FIG. 11 shows a flowchart of transport control of recording material in a modified example of the above-mentioned exemplary embodiment. In this case, the discharge of recording material to the post-processing device side is distributed according to the size and thickness of the recording material, and also according to whether the post-processing is selected or not.

In FIG. 11, first, whether or not the size of the recording material is equal to or larger than a predetermined size previously specified is judged (step S11). In case that the size of the recording material is judged to be equal to or larger than the predetermined size, whether or not the thickness thereof. Is equal to or smaller than the predetermined thickness is next judged (step S12). In case that the thickness is judged to equal to or smaller than the predetermined thickness, whether recording is two-sided recording or one-sided recording is next judged (step S13). At this time, in case that recording is judged to be the two-sided recording, the switcher 39 is switched to the second discharge roll 37 side (step S14: the transport control enables the recording material to proceed to the second discharge roll 37 side). Thereafter, whether this two-sided recording is completed or not is judged (step S15). In case that the two-sided recording has been completed, (at appropriate timing on and after a point of time when the recording material of which one side has recording has passed through the switcher 39), whether post-processing in the post-processing device is selected or not is judged (step S16). In case that the post-processing is selected, the switcher 39 is switched to the first discharge roll 36 side so that the recording material is transported to the post-processing device (step S17), and output is completed. Further, in case that recording is judged to be not the two-sided recording in the step S13, processing proceeds directly to the step S16. Further, in case that it is judged in the step S16 that the post-processing is not selected, the switcher 39 is switched to the second discharge roll 37 side (step S18), and output is completed.

Further, in case that the used material is judged to have the size smaller than the predetermined size in the step S11, or judged to have thickness over the predetermined thickness in the step S12, processing proceeds to a step S18, and output is completed.

Hereby, in case that the used recording material has the size equal to or larger than the predetermined size, and has the thickness equal to or smaller than the predetermined thickness, the recording material requiring the post-processing is output to the punching unit 40 side, and the other recording materials can be output from the second discharge roll 37. Accordingly, it is also possible to distribute the recording materials to destinations of discharge according to the presence of the post-processing.

Further, in case that the recording materials are thus distributed to the destinations of discharge also according to the presence of the post-processing, another recording material discharge portion may be further provided on the image forming apparatus 10 side (for example, a path for discharging the recording material from the protruding portion 10*a* in FIG. 2 to the left side is provided), and the recording material which has the size equal to or larger than the predetermined size and the thickness equal to or smaller than the predetermined thickness, and does not require the post-processing may be output to this recording material discharge portion, whereby the recording materials are distributed much more.

The presence of selection in such the post-processing may be recognized by operation of the UI screen 103 (refer to, for example, FIG. 3)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material processing apparatus comprising:

an image forming apparatus including:

an imaging section that forms an image on a recording material; and a first recording material output portion onto which the recording material having the image formed thereon by the imaging section is output and accommodated;

a post-processing device that is provided attached to the image forming apparatus, the post-processing device including:

a post-processing section that selectively subjects a recording material having post-processing permissible size and thickness to a post-processing; and a second recording material output portion onto which the recording material passed through the post-processing section is output and accommodated;

a recording material judging section that judges whether the recording material used in the image forming apparatus has the post-processing permissible size and thickness or not; and a recording material transport controlling section that permits, when the recording material judging section judges the recording material has the post-processing permissible size and thickness, the recording material to be transported into the post-processing device, and permits, when the recording material judging section judges the recording material does not have the post-processing permissible size and thickness, the recording material to be transported to the first recording material output portion;

a post-processing device housing that houses the post-processing section therein;

a transport path that transports the recording material, the transport path is provided in the post-processing device housing; and a curved transport path which is provided at a part of the transport path, the curved transport path is curved to such a degree that the recording material not having the post-processing permissible size and thickness cannot follow, wherein the post-processing section is provided correspondingly to the curved transport path.

2. The recording material processing apparatus according to claim 1, wherein the image forming apparatus further includes:

an apparatus housing that houses the imaging section therein;

a protruding portion that is provided upward at one top portion of the apparatus housing; and an image reading device that reads a document image, wherein the image reading device installed above the protruding portion, and the image reading device and the top portion of the apparatus housing except the protruding portion forms a space therebetween, and the post-processing device further includes:

a post-processing device housing that houses the post-processing section therein, and has a lateral-direction housing portion which is arranged in the space, the lateral-direction housing portion extends in a lateral direction and in a state where the upper area of the space is left, and a top portion of the lateral-direction housing portion is used as the first recording material output portion.

3. The recording material processing apparatus according to claim 1, wherein the post-processing device includes the curved transport path near an entrance of the transport path in the post-processing device housing; and the post-processing section is a punching section having a puncher which comes into contact with or separates from the curved transport path.

4. The recording material processing apparatus according to claim 3, wherein the post-processing device includes a punch controlling section that controls a punching operation by the punching section; and the punch controlling section controls the punching section so that a punching position on the recording material is determined based on the distance from a lead edge portion of the recording material transported in the transport path and the punching operation is performed.

5. The recording material processing apparatus according to claim 1, wherein a plurality of transport members is provided on the transport path of the post-processing device, the plurality of transport members gives transporting powers to the recording material, and the plural transport members are arranged at intervals in which only the recording material having the post-processing permissible size and thickness can be transported.

6. The recording material processing apparatus according to claim 1, further comprising:

a post-processing selection section that determines whether the post-processing on the recording material used in the image forming apparatus is performed or not, wherein the recording material transport controlling section permits, when the recording material judging section judges the recording material has the post-processing permissible size and thickness and the post-processing selection section determines that the post processing is performed, the recording material to be transported into the post-processing device, and permits, when the recording material judging section judges the recording material does not have the post-processing permissible size and thickness and the post-processing selection section determines that the post-processing is not performed, the recording material to be transported to the first recording material output portion.

7. A recording material processing apparatus comprising:

an image forming apparatus including:

an imaging section that forms an image on a recording material; and a first recording material output portion onto which the recording material having the image formed thereon by the imaging section is output and accommodated;

a post-processing device that is provided attached to the image forming apparatus, the post-processing device including:

a post-processing section that selectively subjects a recording material having post-processing permissible thickness to a post-processing;

a second recording material output portion onto which the recording material passed through the post-processing section is output and accommodated;

a recording material judging section that judges whether the recording material used in the image forming apparatus has the post-processing permissible thickness or not; and a recording material transport controlling section that permits, when the recording material judging section judges the recording material has the post-processing permissible thickness, the recording material to be transported into the post-processing device, and permits, when the recording material judging section judges the recording material does not have the post-processing permissible thickness, the recording material to be transported to the first recording material output portion;

a post-processing device housing that houses the post-processing section therein;

a transport path that transports the recording material, the transport path is provided in the post-processing device housing; and a curved transport path which is provided at a part of the transport path, the curved transport path is curved to such a degree that the recording material not having the post-processing thickness cannot follow, wherein the post-processing section is provided correspondingly to the curved transport path.

* * * * *